US011098535B2

(12) United States Patent
Prescott, Jr. et al.

(10) Patent No.: US 11,098,535 B2
(45) Date of Patent: Aug. 24, 2021

(54) SYSTEMS AND METHODS FOR TUBULAR ELEMENT HANDLING

(71) Applicant: Helmerich & Payne, Inc., Tulsa, OK (US)

(72) Inventors: Jerry Ray Prescott, Jr., Tulsa, OK (US); Joel Ferland, Bixby, OK (US); Matthew Wyatt MacDaniels, Oologah, OK (US); Christopher Alan Major, Tulsa, OK (US); Patrick L. Gustafson, Owasso, OK (US); Robert Lee Stauder, Broken Arrow, OK (US); Bernard Cook, Tulsa, OK (US); DeWayne Speer, Tulsa, OK (US)

(73) Assignee: HELMERICH & PAYNE, INC., Tulsa, OK (US)

( * ) Notice: Subject to any disclaimer, the term of this patent is extended or adjusted under 35 U.S.C. 154(b) by 18 days.

(21) Appl. No.: 16/518,732

(22) Filed: Jul. 22, 2019

(65) Prior Publication Data

US 2020/0024914 A1 Jan. 23, 2020

Related U.S. Application Data

(60) Provisional application No. 62/702,214, filed on Jul. 23, 2018.

(51) Int. Cl.

| | |
|---|---|
| ***E21B 19/00*** | (2006.01) |
| ***E21B 15/00*** | (2006.01) |
| ***E21B 19/16*** | (2006.01) |

(52) U.S. Cl.
CPC ..... *E21B 15/00* (2013.01); *E21B 19/00* (2013.01); *E21B 19/165* (2013.01)

(58) Field of Classification Search
CPC ..... E21B 15/00; E21B 19/00; E21B 19/02; E21B 19/165; B66C 5/02; B66C 5/04; B66C 7/02; B66C 7/04; B66C 7/08; B66C 17/12
See application file for complete search history.

(56) References Cited

U.S. PATENT DOCUMENTS

2014/0332487 A1* 11/2014 Boutwell, Jr. ..... B66C 19/00 212/199
2017/0159378 A1* 6/2017 Huchon ..... E21B 19/084

* cited by examiner

*Primary Examiner* — D. Andrews
(74) *Attorney, Agent, or Firm* — Kilpatrick Townsend & Stockton LLP

(57) ABSTRACT

A system and method for transferring tubular elements may include a first structure having a first horizontal platform attached to the first structure on a bottom side and a monorail attached to the first structure on a top side, a second structure having a second horizontal platform attached to the second structure. The first structure and the second structure may be located proximate to each other, while the monorail can extend from the first structure to the second structure. The monorail can have a motion controlled assembly to move a tubular element or assembly of tubular elements.

29 Claims, 9 Drawing Sheets

SYSTEMS AND METHODS FOR TUBULAR ELEMENT HANDLING

CROSS-REFERENCE TO RELATED APPLICATION

This application claims the benefit of and priority to U.S. Provisional Patent Application Ser. No. 62/702,214, filed on Jul. 23, 2018, and entitled "Systems and Methods for Stand Transfer System for Drilling," which is hereby incorporated by reference as if fully set forth herein.

BACKGROUND

Field of the Disclosure

The present disclosure relates generally to drilling equipment and, more particularly, to systems and methods for tubular element handling.

Description of the Related Art

During drilling operations, it is common for individual joints of tubular elements to be attached together, such as by screwing one of a first joint to an end of another joint. The tubular element may be a pipe, a casing, a collar, a mud motor, a stabilizer, a milling device, or other downhole tool or device. The individual joints are connected and the process may be repeated as the drillstring is put together with various tubular elements and is lowered into the borehole as the well. However, this approach can prove costly as it may slow the drilling process, due to the relatively large number of joints that must be connected. Instead, it may be helpful for several joints to be attached to one another to create a tubular element assembly (which typically may comprise two or more individual tubular elements), and then attach one end of the tubular element assembly to the end of the joint at the surface end of the drillstring.

SUMMARY

In one aspect, a first system for transferring tubular elements is disclosed. The first system may include a first vertical storage structure having a first drilling structure attached to the first vertical storage structure. In the first system, the first drilling structure may have a first racking board attached to the first structure on a bottom side and a monorail attached to the first drilling structure on a top side. The first system may further include a second vertical storage structure having a second drilling structure attached to the second vertical storage structure. In the first system, the second drilling structure may have a second racking board attached to the second drilling structure. In the first system, the first drilling structure and the second drilling structure may be located proximate to each other, while the monorail may extend from the first drilling structure to the second drilling structure. In the first system, the monorail may have a movable trolley attached to the monorail and the movable trolley may be configured to hold a tubular element or assembly of tubular elements and move from a first position to a second position. In the first system, the tubular element or assembly of tubular elements may be moved from the first drilling structure to the second drilling structure.

In any of the disclosed embodiments of the first system, the movable trolley may be movable in response to an operator command.

In any of the disclosed embodiments of the first system, the first drilling structure and the second drilling structure may be attached to the first vertical storage structure and the second vertical storage structure, respectively, at substantially a same height.

In any of the disclosed embodiments of the first system, the movable trolley may be configured to lift a tubular element or assembly of tubular elements in response to an operator command.

In any of the disclosed embodiments of the first system, the movable trolley may be configured to lower a tubular element or assembly of tubular elements in response to an operator command.

In any of the disclosed embodiments of the first system, the first vertical storage structure may be located proximate to a first well borehole that contains a portion of a drillstring.

In any of the disclosed embodiments of the first system, the second vertical storage structure may be located proximate to a second well borehole.

In any of the disclosed embodiments of the first system, the first vertical storage structure may be configured to move a tubular element or assembly of tubular elements from the drillstring in the first well borehole and transfer the tubular element or assembly of tubular elements to the second vertical storage structure.

In yet another aspect, a first method for drilling a well is disclosed. The first method may include positioning a first drilling rig proximate to a surface location for drilling a first wellbore, positioning a second drilling rig proximate to a surface location of a second wellbore and proximate to the first drilling rig. In the first method, the second drilling rig may have a structure attached to the second drilling rig. In the first method, the structure may have a monorail attached to the structure and the monorail may have a motorized and movable trolley attached to the monorail. In the first method, the monorail and the trolley may be configured to move a tubular element or assembly of tubular elements from the second drilling rig to the first drilling rig. The first method may further include, with the second drilling rig, breaking out a connection of a tubular element or assembly of tubular elements from a drillstring of the second well borehole, and, with the movable trolley, lifting the tubular element or assembly of tubular elements. The first method may further include, with the movable trolley, moving the tubular element or assembly of tubular elements from a first position from the second drilling rig to a second position at the first drilling rig.

In any of the disclosed embodiments, the first method may further include attaching the tubular element or assembly of tubular elements to a drillstring in the first wellbore, releasing the tubular element or assembly of tubular elements from the hoist, and moving the trolley from the first drilling rig back to the second drilling rig.

In any of the disclosed embodiments, the first method may further include drilling the first well borehole by the first drilling rig, and tripping out the drillstring from the second well borehole by the second drilling rig.

In any of the disclosed embodiments, the first method may further be automated and performed by a computer system executing computer software instructions stored on the computer system.

In any of the disclosed embodiments of the first method, the first drilling rig and the second drilling rig may be 200 feet or less from one another.

In any of the disclosed embodiments of the first method, the method may be performed in 60 seconds or less, 75 seconds or less, 90 seconds or less, or 120 seconds or less.

In any of the disclosed embodiments of the first method, performing the method may take from 40 seconds to 90 seconds to complete.

In another aspect, a second system for transferring tubular elements is disclosed. The second system may include a first structure having a first horizontal platform attached to the first structure on a bottom side and a monorail attached to the first structure on a top side. The second system may further include a second structure having a second horizontal platform attached to the second structure. In the second system, the first structure and the second structure may be located proximate to each other, while the monorail may extend from the first structure to the second structure. In the second system, the monorail may have a motion controlled assembly attached to the monorail and the motion controlled assembly may be configured to hold a tubular element or assembly of tubular elements and move the tubular element or assembly of tubular elements from the first structure to the second structure.

In any of the disclosed embodiments of the second system, the motion controlled assembly may be motion controlled in response to an operator command.

In any of the disclosed embodiments of the second system, the first structure and the second structure may be at substantially a same height.

In any of the disclosed embodiments of the second system, the motion controlled assembly may be configured to lift the tubular element or assembly of tubular elements in response to an operator command.

In any of the disclosed embodiments of the second system, the motion controlled assembly may be configured to lower the tubular element or assembly of tubular elements in response to an operator command.

In any of the disclosed embodiments of the second system, the first structure may be a first vertical storage structure of a first drilling rig located proximate to a first well borehole that contains a portion of a drillstring.

In any of the disclosed embodiments of the second system, the second structure may be a second vertical storage structure of a second drilling rig located proximate to a second well borehole.

In any of the disclosed embodiments of the second system, the motion controlled assembly may be configured to move the tubular element or assembly of tubular elements between the first vertical storage structure and the second vertical storage.

In still a further aspect a second method for drilling a well is disclosed. The second method may include positioning a first structure proximate to a surface location of a first wellbore, positioning a second structure proximate to a surface location of a second wellbore and proximate to the first wellbore. In the second method, the second structure may have a transfer structure attached to the second structure. In the second method, the transfer structure may have a monorail attached to the transfer structure and the monorail may have a motion controlled assembly attached to the monorail. In the second method, the monorail and the motion controlled assembly may be configured to move a tubular element or assembly of tubular elements between the first structure and the second structure. The second method may further include, with the second structure, breaking out a connection of a tubular element or assembly of tubular elements from a drillstring of the second well borehole and lifting the tubular element or assembly of tubular elements. The second method may further include, with the motion controlled assembly, moving the tubular element or assembly of tubular elements from a first position from the second structure to a second position at the first structure.

In any of the disclosed embodiments, the second method may further include attaching the tubular element or assembly of tubular elements to a drillstring in the first wellbore, releasing the tubular element or assembly of tubular elements from a hoist, and moving the motion controlled assembly from the first structure back to the second structure.

In any of the disclosed embodiments, the second method may be automated and performed by a computer system executing computer software instructions stored on the computer system.

In any of the disclosed embodiments of the second method, the first structure and the second structure may be less than or equal to 200 feet apart.

In any of the disclosed embodiments, the second method may be performed in less than or equal to 60 seconds, less than or equal to 75 seconds, less than or equal to 90 seconds, or less than or equal to 120 seconds.

In any of the disclosed embodiments, performing the second method may take from 40 seconds to 90 seconds to complete.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

In the following description, details are set forth by way of example to facilitate discussion of the disclosed subject matter. It should be apparent to a person of ordinary skill in the field, however, that the disclosed embodiments are exemplary and not exhaustive of all possible embodiments.

The present disclosure includes systems and methods for tubular element handling useful for tubular element handling drilling operations, and allows for a tubular element or assembly of tubular elements to be made up in close proximity to a first structure, such as a first drilling rig, and the end of the drillstring at the surface. The tubular element handling system may transfer a tubular element or assembly of tubular elements while the first structure is operating, such as by continuing to perform drilling. Then, the tubular element or assembly of tubular elements may be easily transferred so that the tubular element or assembly of tubular elements can be attached to the surface end of the drillstring. Although in the following description reference is made to a drilling rig having a mast, it is noted that the tubular element handling systems and methods disclosed herein are not limited in such a manner and may be used with any type of structure or storage structure associated with tubular elements. The tubular element comprising the tubular element assembly may be a pipe, a casing, a collar, a mud motor, a stabilizer, a milling device, other downhole tool or device, or various combinations thereof.

Figure 1:
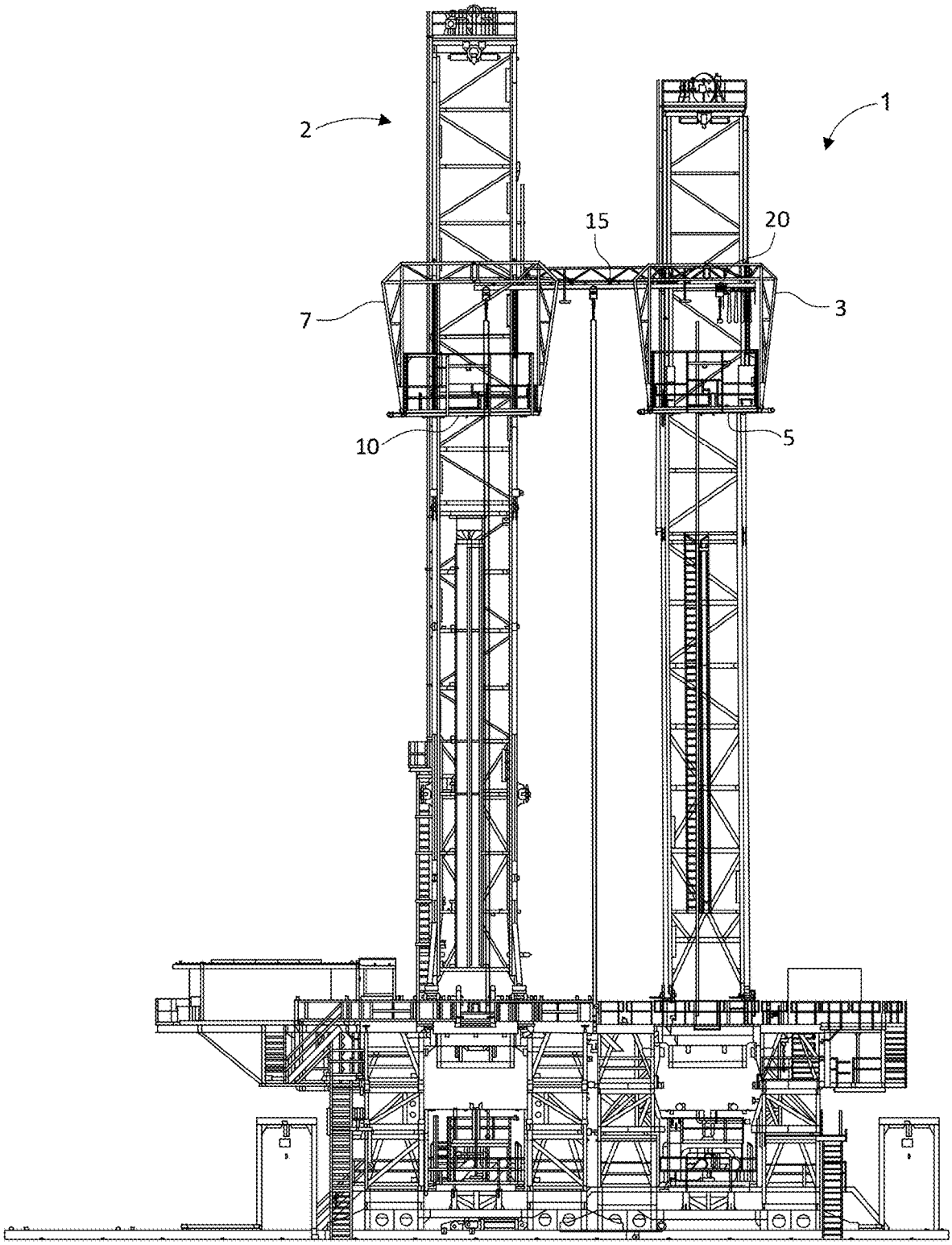
FIG. 1 depicts two drilling structures adjacent to each other.
Figure 2:
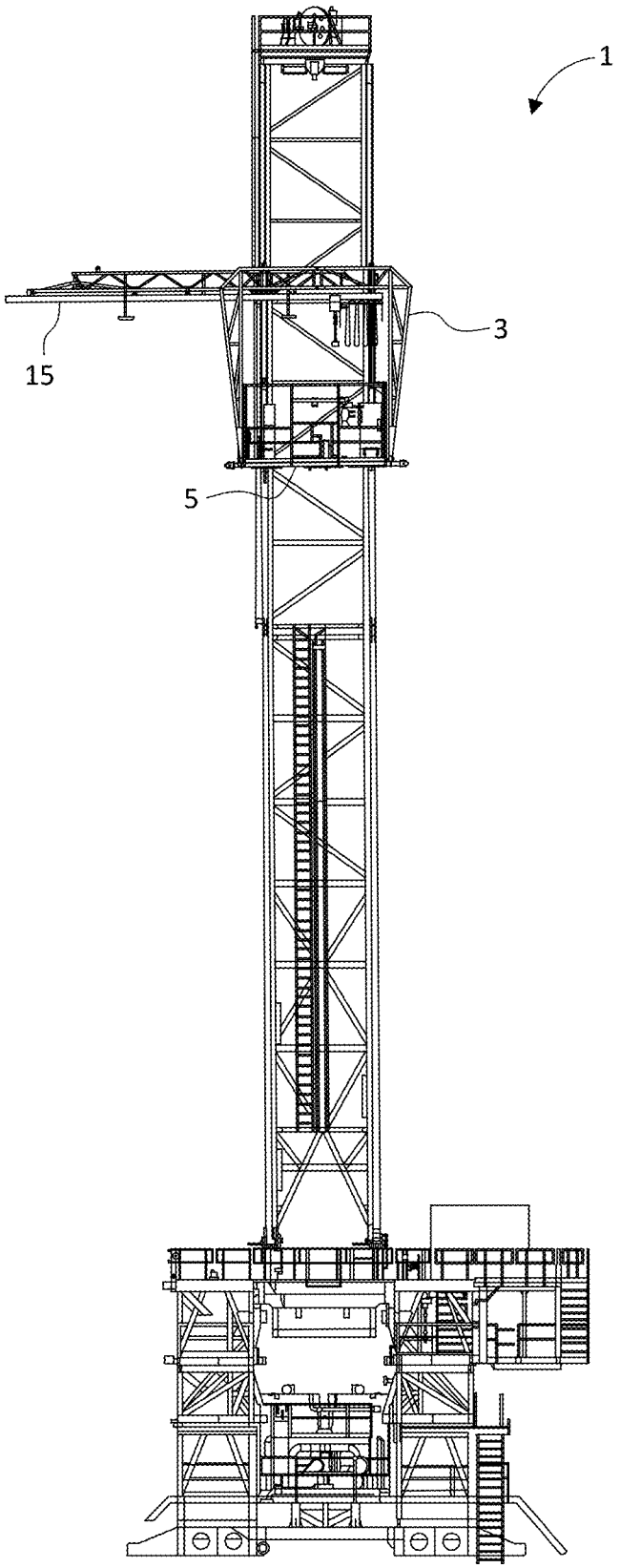
FIGS. 2-8 depict additional details and provide additional views of the system for transferring tubular element stands.
Figure 3:
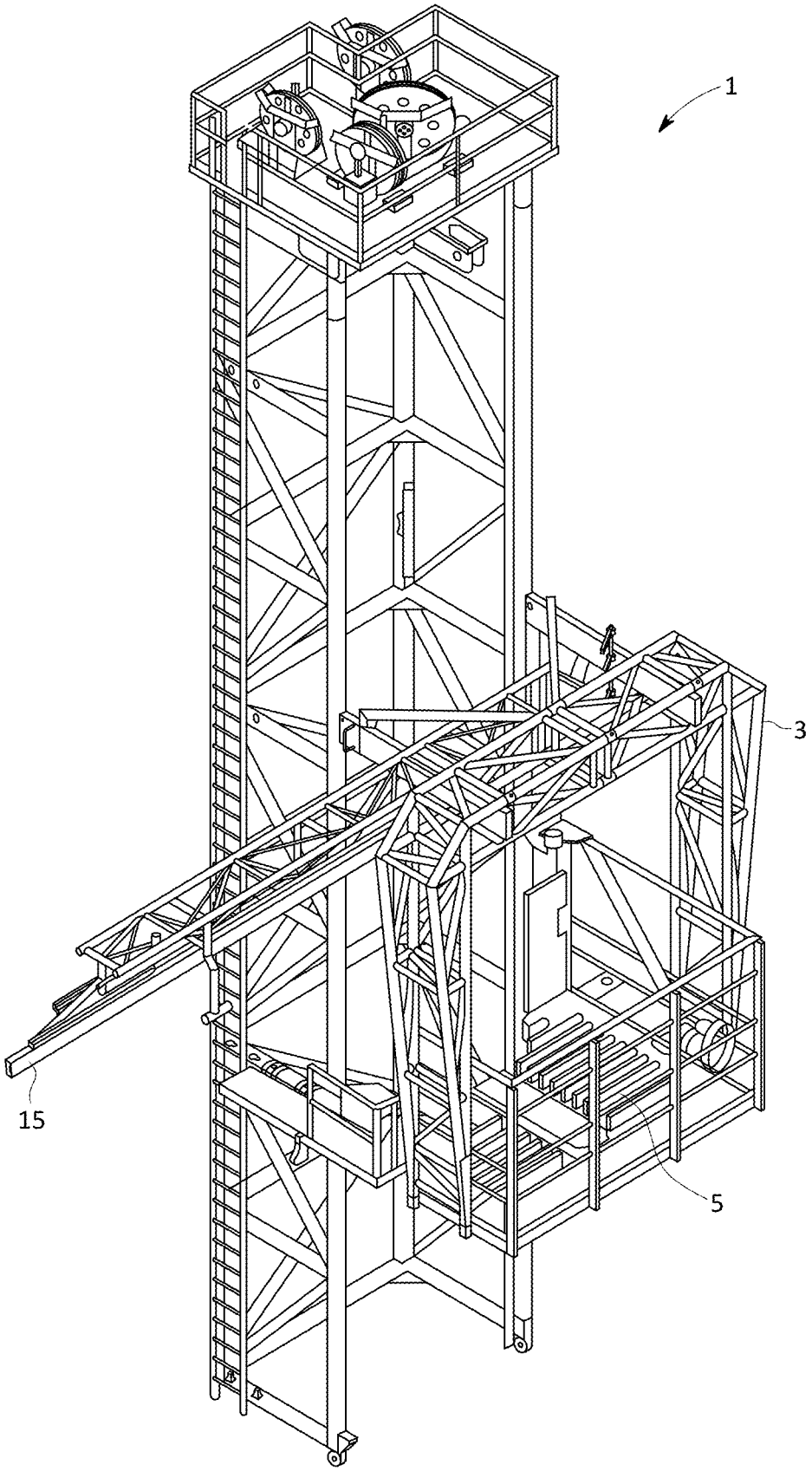
Figure 4:
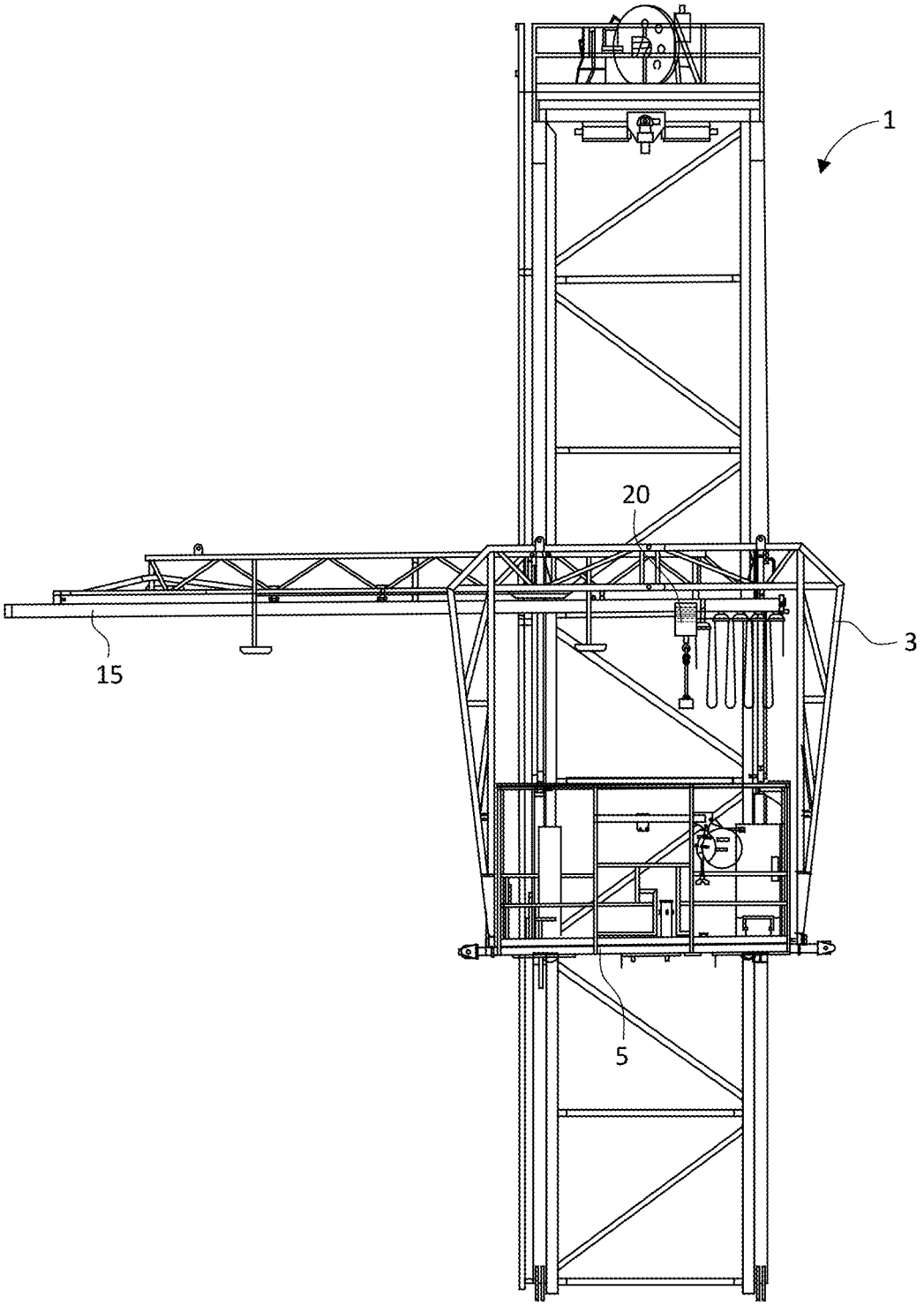
Figure 5:
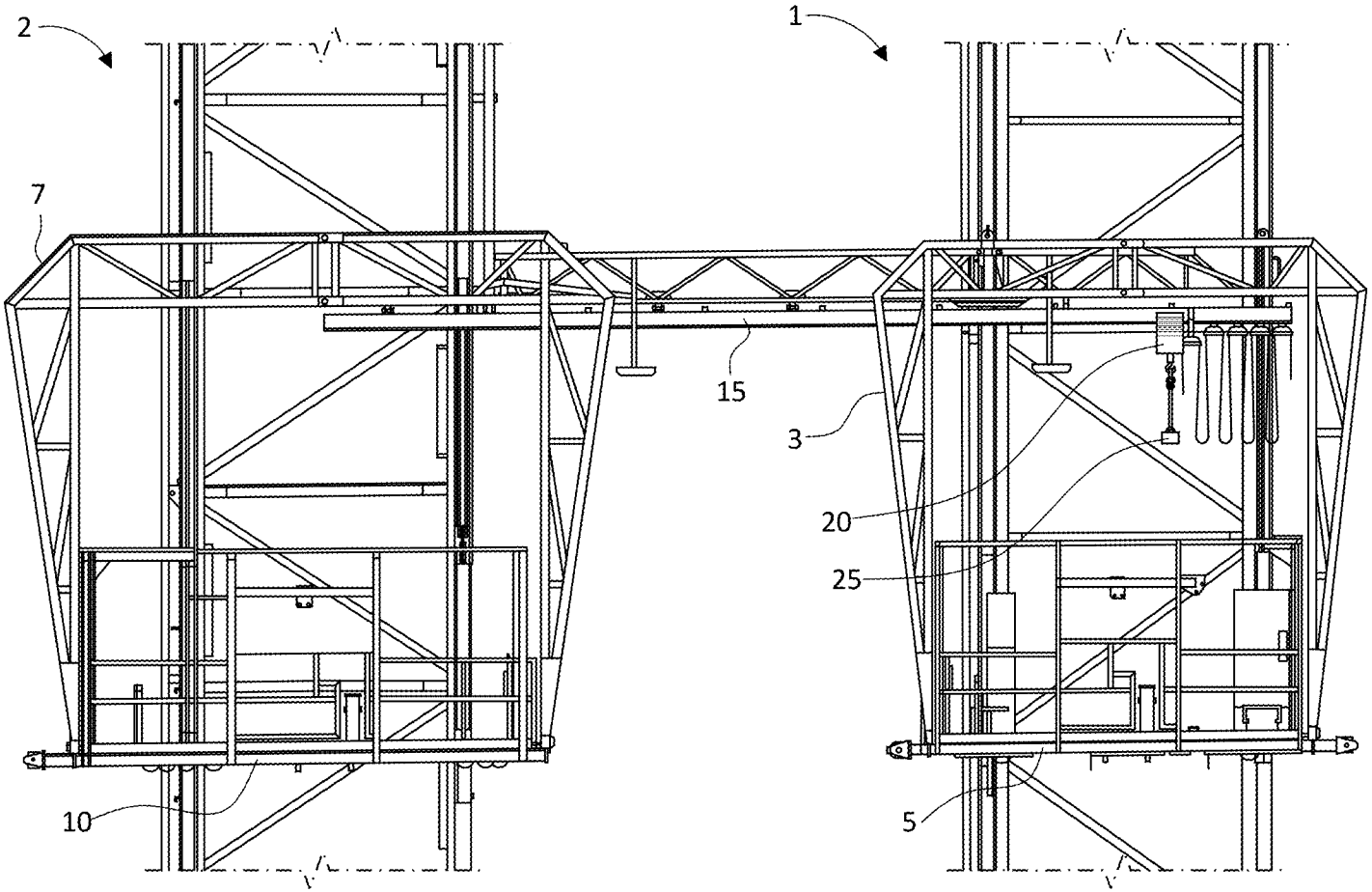

In one embodiment of the present disclosure, the tubular element handling system may be utilized to transfer or pass a tubular element or assembly of tubular elements (e.g., stands of drilling pipe) between two adjacent structures, such as two drilling rigs having respective masts (or other vertical storage structures) that are adjacent to one another, as shown in FIG. 1. The tubular element handling system in one embodiment may comprise two L-shaped gantry members and a truss strengthened trolley beam that can be attached to a structure, such as a mast and racking board of a drilling rig. A motorized hoist may be used to lift the tubular element or assembly of tubular elements (e.g., 2 inches-2 feet) above a work floor on the first drilling rig and a motorized trolley that the hoist is attached to can be used to move the tubular element or assembly of tubular elements outside of the first drilling rig's racking board and along the beam towards the second drilling rig. Once the tubular element or assembly of tubular elements has entered into the second drilling rig's racking board, the motorized hoist can be used to lower the tubular element or assembly of tubular elements to the drilling rig floor. On each of the drilling rigs' racking board the structure may be modified to allow passage of a tubular element or assembly of tubular elements in and out of the racking board itself. For example, a gate may be located at each of these passage ways that only allows the tubular element or assembly of tubular elements to move in one direction with respect to that racking board. This approach and configuration helps prevent a tubular element or assembly of tubular elements that may somehow be accidentally released from the hoist from falling outside of the racking boards. In this embodiment, once the tubular element or assembly of tubular elements is located outside of the racking board, there are two beams that extend away from each drilling rig towards the other drilling rig to create another passage way to contain a falling tubular element or assembly of tubular elements in case of a failure.

The tubular element handling system in this embodiment may repeatedly move tubular element or assembly of tubular elements between structures, such as from one drilling rig to another during drilling or during tripping. In one embodiment, a drilling rig used for drilling a well borehole may move to a second location after the borehole is drilled and commence drilling another well borehole. In the meantime, the second drilling rig can be moved to the opening of the first well borehole and then be used for tripping out the drillstring from the first well while the first drilling rig is being used to drill the second well borehole. In this embodiment, the second drilling rig can be used to break out each tubular element or assembly of tubular elements from the drillstring of the first well borehole and transfer each tubular element or assembly of tubular elements to the first drilling rig that is being used to drill the second well borehole. When the drillstring has been removed by the second drilling rig from the first well borehole, then the second drilling rig can be moved if desired or can remain in place and can be used in combination with the first drilling rig to help in drilling of the second well borehole, such as by using the second drilling rig to make tubular element or assembly of tubular elements, which can be transferred to the first drilling rig for drilling the second well borehole as described above. In this way, the systems and methods of the present disclosure help to improve drilling efficiency, for example since the first drilling rig can be utilized to drill a second well instead of tripping tubular elements out of the previous well's borehole.

Figure 9:
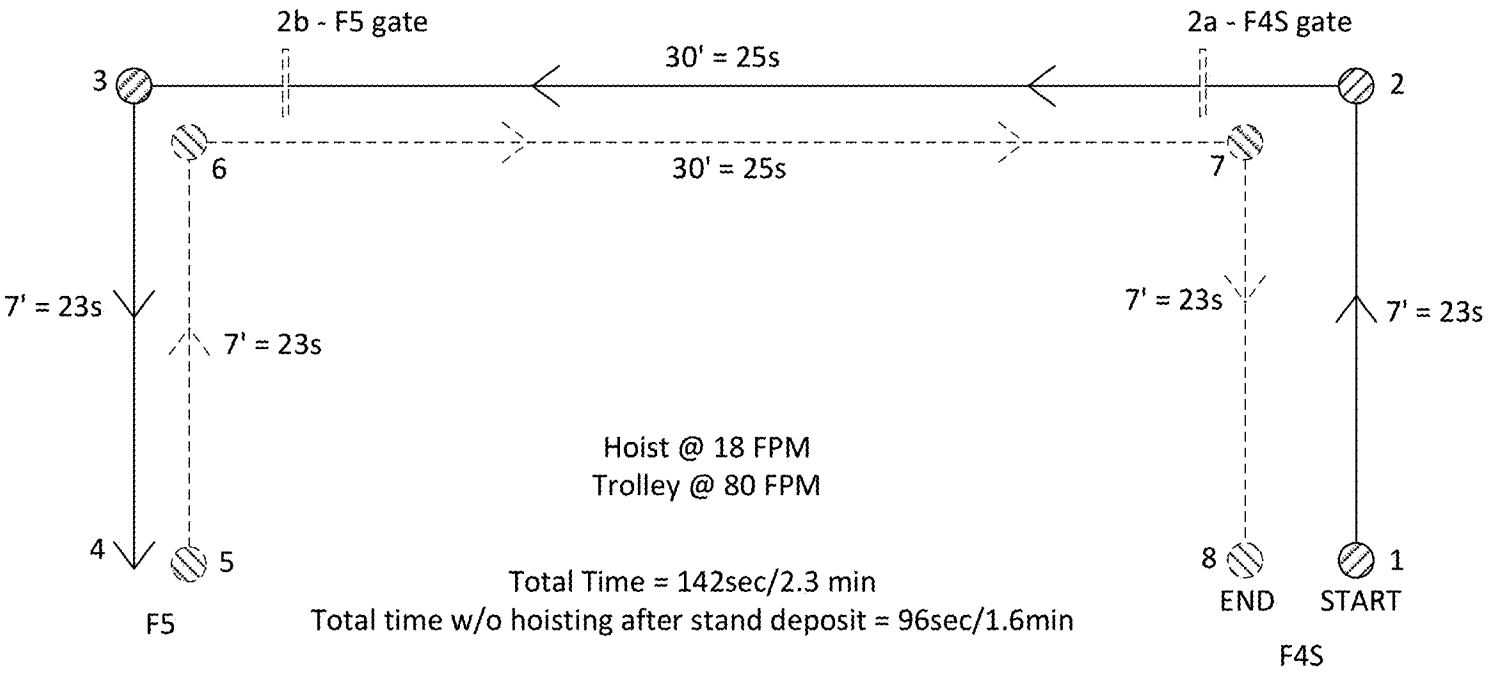
FIG. 9 illustrates a sequence of operations for the transfer of a tubular element stand.

For a more complete understanding, reference is now made to the following description taken in conjunction with the accompanying drawings. FIGS. 1-8 illustrate various features and functions of the stand transfer system in one or more embodiments. FIG. 9 illustrates a sequence of operations for the transfer of a tubular element or assembly of tubular elements from one drilling rig and the movement of the trolley.

Referring to FIG. 1, two drilling rigs respectively having masts 1 and 2 are shown in close proximity to one another. As noted previously, the drilling rigs and masts are depicted as exemplary structures in one non-limiting implementation of the tubular element handling methods and systems disclosed herein, and it will be understood that other structures may be used in various embodiments. As illustrated in FIG. 1, the drilling rigs 1 and 2 can share the same rig floor. Each of the drilling rigs may have a racking board—drilling rig 1 has racking board 5 and drilling rig 2 has racking board 10. The racking boards 5 and 10 may be securely attached to the drilling rigs 1 and 2, respectively, at a desired height above the drilling rig floor (or, if desired, the height may be selected with respect to a desired height above ground or surface level). In one embodiment, each of the drilling rigs 1 and 2 may have a rig floor, and, when the two drilling rigs 1 and 2 are positioned in close proximity, the two rig floors may effectively provide a single rig floor.

The racking boards 5 and 10 may comprise a gantry support structure of first and second structures 3 and 7, respectively, which may be attached to the drilling rigs 1 and 2, as well as racking boards 5 and 10, respectively. The gantry support structures 3 and 7 may be designed to provide additional structural support to the racking board deck surface. The racking boards and support structures may be designed to hold one or more workers who may operate and/or control the tubular element transfer operations, such as are described herein.

Also shown in FIG. 1 is a monorail or beam 15. The monorail 15 may be attached to the top of the structure 3 and, as shown in FIG. 1, may be configured to extend between the first drilling rig 1 and the second drilling rig 2. As shown in FIG. 1 the monorail 15 is level, such that structures 3 and 7 are at the same height. The monorail 15 may have a movable trolley 20 attached to monorail 15. The movable trolley 20 may be configured to hold, lift, and/or lower one or more tubular element or assembly of tubular elements, and to move between the first drilling rig 1 and the second drilling rig 2 to transfer the one or more tubular element or assembly of tubular elements between the first drilling rig and the second drilling rig. In at least one embodiment, the movable trolley 20 includes a motion controlled assembly and is motorized, and may be controlled to move and/or stop in response to an operator's command. A control device that the operator can use to generate the operator command for the movable trolley may be mounted on the structure 3, the structure 7, and/or elsewhere on drilling rig 1 and/or drilling rig 2. In another embodiment, the trolley may be controlled via wireless remote or remotes by an operator located on racking board 5 and/or 10, and/or elsewhere on drilling rig 1 and/or 2. In addition, the trolley may be configured with one or more pulley systems or other systems configured to lift and/or lower tubular element or assembly of tubular elements as desired, and such systems may also be controlled by an operator from a control system therefor, with the control system mounted on or near the structure 3, the structure 7, or elsewhere on drilling rig 1 and/or drilling rig 2 as desired or with a wireless control system with a remote which can be operated from racking board 5 and/or 10, and/or elsewhere on drilling rig 1 and/or 2. Additionally, the pulley system may have an "elevator" latch 25 affixed to the end of the lifting end of the cable or chain for connecting and latching to a tubular element or assembly of tubular elements.

Figure 6:
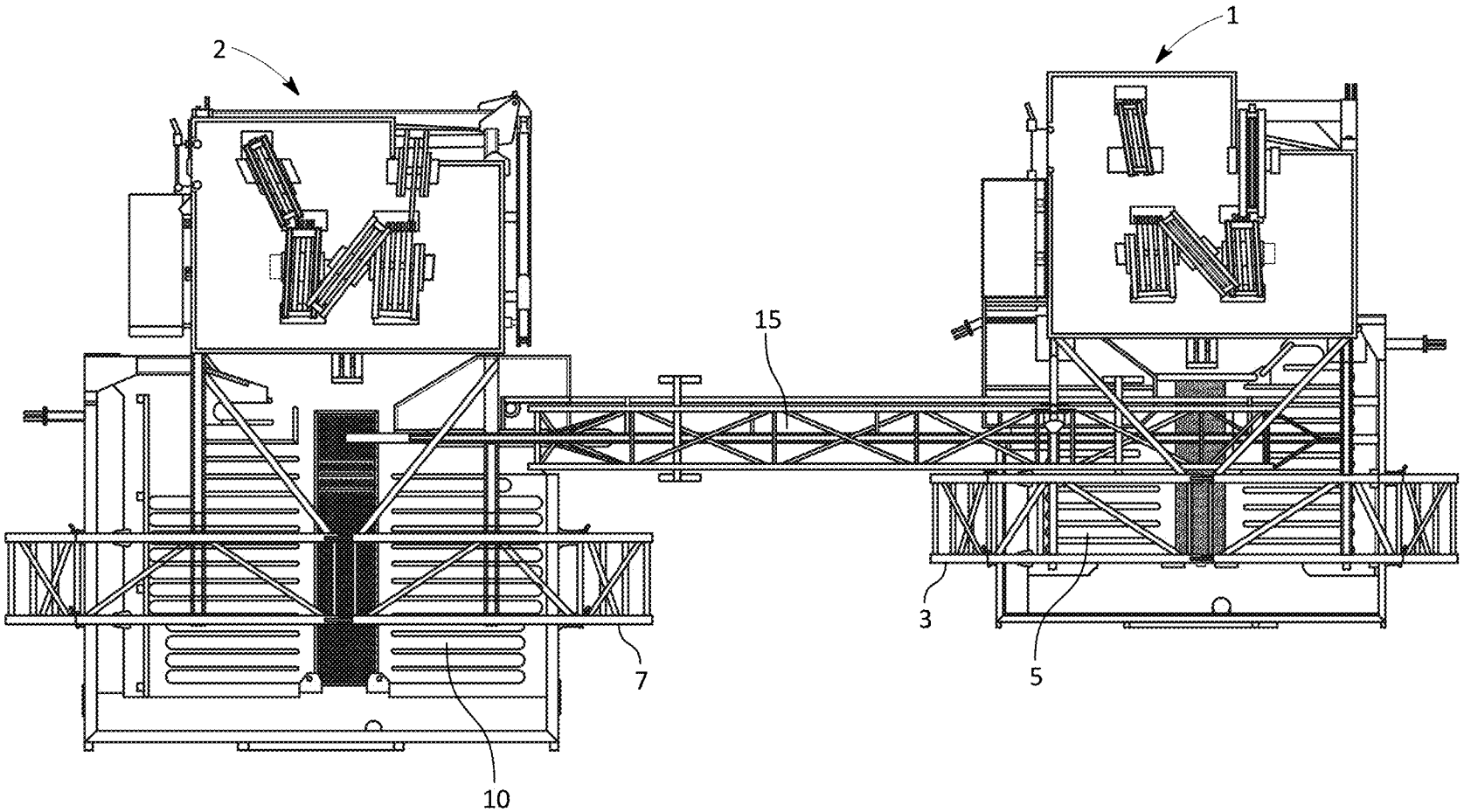
Figure 7:
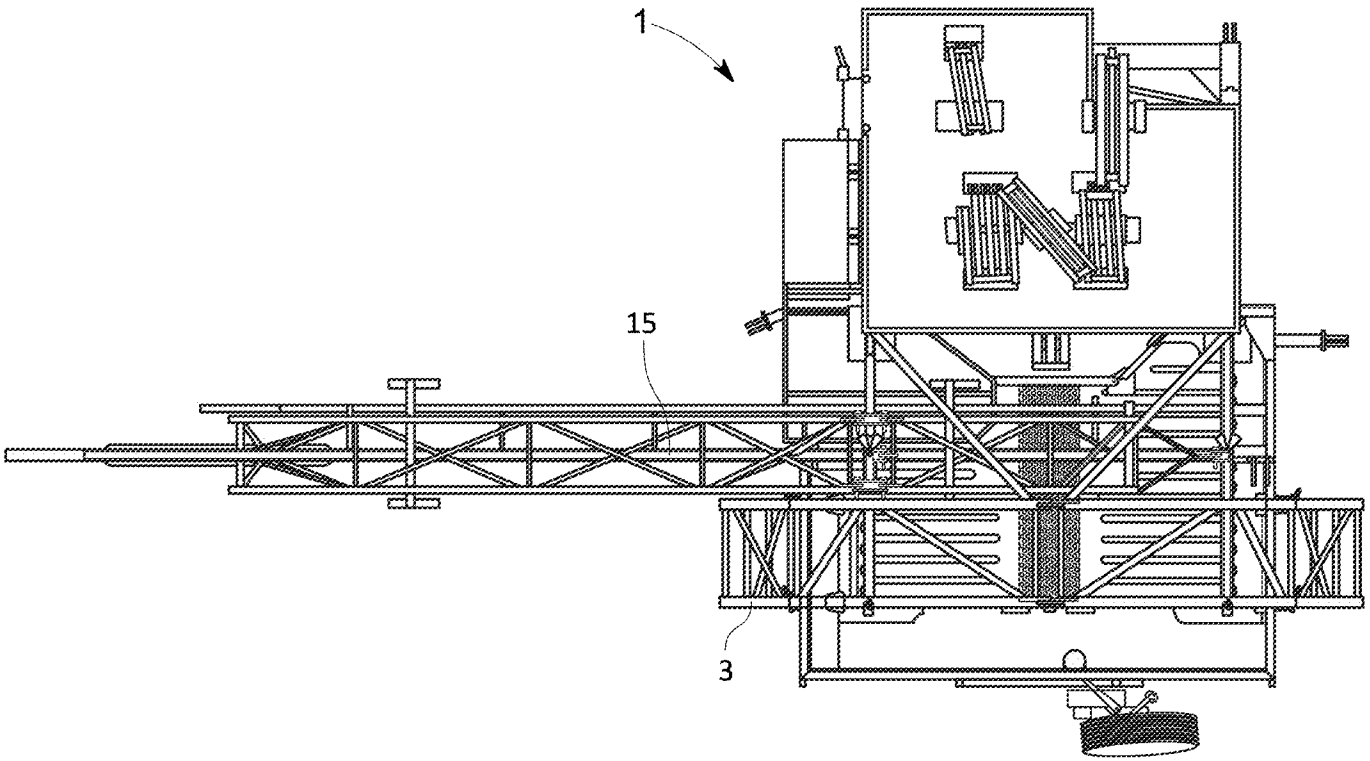
Figure 8:
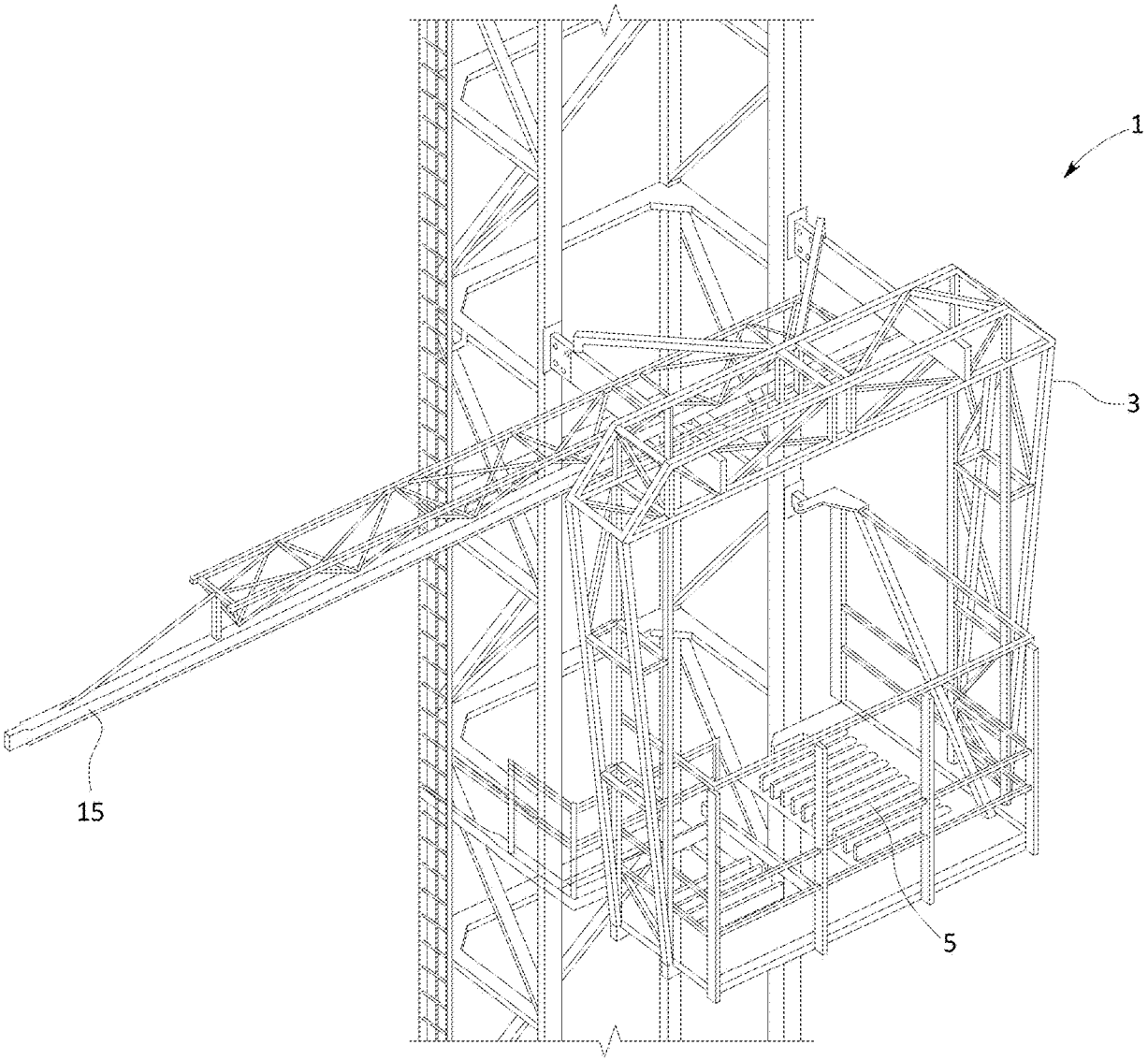

FIGS. 2-8 illustrate additional details and provide additional views of the system for transferring tubular element or assembly of tubular elements in accordance with the present disclosure. For example, FIG. 6 illustrates the first and second drilling rigs 1 and 2 located near one another in a plan view. As shown in FIG. 6, the racking boards 5 and 10 each have a wider opening between the boards in corners facing each other. These openings are configured to allow the tubular element or assembly of tubular elements to move easily from the approximate centers of the structures 3 and 7 and extend downwardly from the structures. Although not shown, either or both of the structures 3 and 7 may have a spring-loaded gate or other feature that allows the tubular element or assembly of tubular elements to easily move from outside the structure to inside it, but nonetheless swings shut and/or latches automatically to prevent the tubular element or assembly of tubular elements from moving outside the structure within which the tubular element or assembly of tubular elements is then located.

Typically, the monorail can be anywhere from about 10 feet long to about 60 feet long, and the distance between the two racking boards may be anywhere from about 5 feet to about 30 feet when the two drilling rigs are located in position for transferring tubular element or assembly of tubular elements between them.

Referring now to FIG. 9, a particular sequence of operations is provided as an example of the use of the stand transfer system as shown and described above. As shown in FIG. 9, one may consider the operation of the tubular element handling system as moving between or among the eight positions diagrammed. In position 1, a floorhand on drilling rig 1 may have control of the operations. The floorhand may move the trolley into position and lower the hoist. A derrickhand on drilling rig 1 may latch a tubular element or assembly of tubular elements, such as by using the tubular element handling system elevators 25, then may inform the drilling rig 1 floorhand that the stand has been latched. The drilling rig 1 floor hand may then use a remote control to lift the tubular element or assembly of tubular elements and, perhaps while the tubular element or assembly of tubular elements is being lifted, the floorhand on drilling rig 1 may also open the safety gate for the racking board 5 on drilling rig 1.

In position 2, the tubular element or assembly of tubular elements may be lifted. While the amount by which the tubular element or assembly of tubular elements is lifted may vary anywhere from 2 inches to 3 feet or so, typically it is expected that the tubular element or assembly of tubular elements will be lifted about eighteen inches off the floor. Once the tubular element or assembly of tubular elements has been lifted, the drilling rig 1 derrickhand may inform the drilling rig 1 floorhand that the gate is open and the tubular element or assembly of tubular elements is ready for movement.

In position 2*a* in FIG. 9, the drilling rig 1 floorhand may use the control to move the trolley 20 along the STS monorail 15, passing through the safety gate on the racking board 5. Once the tubular element or assembly of tubular elements passes the safety gate on the racking board 5 and is outside of the structure 3, the derrickhand on drilling rig 1 may then pass control of the trolley to the floorhand on drilling rig 2 and continue tripping the tubular element or assembly of tubular elements out of the well borehole below drilling rig 1 while the tubular element or assembly of tubular elements is moving to the drilling rig 2.

Once the trolley with the tubular element or assembly of tubular elements reaches the safety gate of the racking board 10 of drilling rig 2, a derrickhand on drilling rig 2 may take control. The derrickhand on drilling rig 2 may move the tubular element or assembly of tubular elements through the safety gate of drilling rig 2 and position the trolley as desired within the racking board 10 of drilling rig 2. The derrickhand on drilling rig 2 may also place rope or other retention or holding means around the tubular element or assembly of tubular elements.

In position 3, the drilling rig 2 floorhand may take control, and may push the tubular element or assembly of tubular elements into the correct position for racking back, and may then lower the tubular element or assembly of tubular elements.

The drilling rig 2 floorhand may have control for position 4 of FIG. 9. The drilling rig 2 floorhand may continue to lower the tubular element or assembly of tubular elements until the derrickhand for drilling rig 2 indicates that the hoist or elevators are low enough for the derrickhand to unlatch them. Once the tubular element or assembly of tubular elements is lowered enough, the derrickhand on drilling rig 2 may unlatch the pipe.

In positions 5 and 6 of FIG. 9, the floorhands may take control over operations once the derrickhand on drilling rig 2 has unlatched the tubular element or assembly of tubular elements.

The drilling rig 2 floorhands may pick the hoist up and then start moving the trolley back outside the drilling rig 2 safety gate and towards drilling rig 1. During this movement period, the drilling rig 2 derrickhand may rack back the tubular element or assembly of tubular elements.

In position 7, the drilling rig 1 floorhand may have control, and may move the trolley back into position in drilling rig 1 for the next tubular element or assembly of tubular elements. At or during this time period, the floorhand for drilling rig 1 also may be moving the next tubular element or assembly of tubular elements into position in drilling rig 1. Once the second tubular element or assembly of tubular elements is in position, and the trolley has been moved back into position for the second tubular element or assembly of tubular elements, the drilling rig 1 derrickhand may instruct the drilling rig 1 floorhand to lower the hoist to pick up the second tubular element or assembly of tubular elements.

The drilling rig 1 floorhand may have control at position 8 in FIG. 9, and may lower the hoist until the drilling rig 1 derrickhand instructs the floorhand to stop the lowering of the hoist. At this point, the drilling rig 1 derrickhand may latch the elevators around the second tubular element or assembly of tubular elements, and then the movement of the second tubular element or assembly of tubular elements starts at position 1, thus repeating the above process.

With respect to the exemplary process diagrammed in FIG. 9, the approximate distances travelling by the trolley and/or tubular element or assembly of tubular elements between the various positions is provided, as is the approximate time for the movements between positions. In some embodiments, a transfer operation is performed in 60 seconds or less, 75 seconds or less, 90 seconds or less, or 120 seconds or less. In some embodiments, the transfer operation takes from 40 seconds to 90 seconds to complete.

As disclosed herein, a system and method for transferring tubular elements may include a first structure having a first horizontal platform attached to the first structure on a bottom side and a monorail attached to the first structure on a top side, a second structure having a second horizontal platform attached to the second structure. The first structure and the second structure may be located proximate to each other, while the monorail can extend from the first structure to the second structure. The monorail can have a motion controlled assembly to move a tubular element or assembly of tubular elements.

It is noted that the system and method for the transfer of tubular element or assembly of tubular elements disclosed herein provides ways to efficiently move tubular element or assembly of tubular elements from a wellbore that has been drilled to a drilling rig drilling a new well borehole and thereby reduce costs and increase the speed of drilling. It is noted that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A system for transferring tubular elements, comprising:

a first vertical storage structure having a first drilling structure attached to the first vertical storage structure, wherein the first drilling structure has a first horizontal platform attached to the first drilling structure on a bottom side and a monorail attached to the first drilling structure on a top side;

a second vertical storage structure having a second drilling structure attached to the second vertical storage structure, wherein the second drilling structure has a second horizontal platform attached to the second drilling structure;

wherein the first drilling structure and the second drilling structure are located proximate to each other, and wherein the monorail extends from the first drilling structure to the second drilling structure; and wherein the monorail has a movable trolley attached to the monorail and the movable trolley is configured to hold a tubular element or assembly of tubular elements and move from a first position to a second position, wherein the tubular element or collection of tubular elements is moved from the first drilling structure to the second drilling structure.

2. The system according to claim 1, wherein the movable trolley is movable in response to an operator command.

3. The system according to claim 1, wherein the first drilling structure and the second drilling structure are attached to the first vertical storage structure and the second vertical storage structure, respectively, at substantially a same height.

4. The system according to claim 1, wherein the movable trolley is configured to lift a tubular element or assembly of tubular elements in response to an operator command.

5. The system according to claim 1, wherein the movable trolley is configured to lower a tubular element or assembly of tubular elements in response to an operator command.

6. The system according to claim 1, wherein the first vertical storage structure is located proximate to a first well borehole that contains a portion of a drillstring.

7. The system according to claim 6, wherein the second vertical storage structure is located proximate to a second well borehole.

8. The system according to claim 7, wherein the first vertical storage structure is configured to move a tubular element or assembly of tubular elements from the drillstring in the first well borehole and transfer the tubular element or assembly of tubular elements to the second vertical storage structure.

9. A method for drilling a well, comprising:

positioning a first drilling rig proximate to a surface location for drilling a first wellbore;

positioning a second drilling rig proximate to a surface location of a second wellbore and proximate to the first drilling rig, wherein the second drilling rig has a structure attached to the second drilling rig, wherein the structure has a horizontal platform attached on a bottom side of the structure and a monorail attached to a top side of the structure and the monorail has a motorized and movable trolley attached to the monorail, and wherein the monorail and the movable trolley are configured to move a tubular element or assembly of tubular elements from the second drilling rig to the first drilling rig;

with the second drilling rig, breaking out a connection of a tubular element or assembly of tubular elements from a drillstring of the second wellbore;

lifting the tubular element or assembly of tubular elements; and with the movable trolley, moving the tubular element or assembly of tubular elements from a first position from the second drilling rig to a second position at the first drilling rig.

10. The method according to claim 9, further comprising:

attaching the tubular element or assembly of tubular elements to a drillstring in the first wellbore;

releasing the tubular element or assembly of tubular elements from a hoist; and moving the movable trolley from the first drilling rig back to the second drilling rig.

11. The method according to claim 9, further comprising:

drilling the first wellbore by the first drilling rig; and tripping out the drillstring from the second wellbore by the second drilling rig.

12. The method according to claim 9, wherein the method is automated and performed by a computer system executing computer software instructions stored on the computer system.

13. The method according to claim 9, wherein the first drilling rig and the second drilling rig are 200 feet or less from one another.

14. The method according to claim 9, wherein the method is performed in 60 seconds or less, 75 seconds or less, 90 seconds or less, or 120 seconds or less.

15. The method according to claim 9, wherein performing the method takes from 40 seconds to 90 seconds to complete.

16. A system for transferring tubular elements, comprising:

a first vertical storage structure having a first drilling structure attached to the first vertical storage structure, wherein the first drilling structure has a first horizontal platform attached to the first drilling structure on a bottom side and a monorail attached to the first drilling structure on a top side;

a second structure having a second horizontal platform attached to the second structure;

wherein the first drilling structure and the second structure are located proximate to each other, and wherein the monorail extends from the first drilling structure to the second structure; and wherein the monorail has a motion controlled assembly attached to the monorail and the motion controlled assembly is configured to hold a tubular element or assembly of tubular elements and move the tubular element or assembly of tubular elements from the first drilling structure to the second structure.

17. The system according to claim 16, wherein the motion controlled assembly is motion controlled in response to an operator command.

18. The system according to claim 16, wherein the first drilling structure and the second structure are at substantially a same height.

19. The system according to claim 16, wherein the motion controlled assembly is configured to lift the tubular element or assembly of tubular elements in response to an operator command.

20. The system according to claim 16, wherein the motion controlled assembly is configured to lower the tubular element or assembly of tubular elements in response to an operator command.

21. The system according to claim 16, wherein the first vertical storage structure is a first vertical storage structure of a first drilling rig located proximate to a first well borehole that contains a portion of a drillstring.

22. The system according to claim 21, wherein the second structure is a second vertical storage structure of a second drilling rig located proximate to a second well borehole.

23. The system according to claim 22, wherein the motion controlled assembly is configured to move the tubular element or assembly of tubular elements between the first vertical storage structure and the second vertical storage structure.

24. A method for drilling a well, comprising:

positioning a first structure proximate to a surface location of a first wellbore;

positioning a second structure proximate to a surface location of a second wellbore and proximate to the first wellbore, wherein the second structure has a transfer structure attached to the second structure, wherein the transfer structure has a horizontal platform attached on a bottom side of the transfer structure and a monorail attached to a top side of the transfer structure and the monorail has a motion controlled trolley attached to the monorail, and wherein the monorail and the motion controlled trolley are configured to move a tubular element or assembly of tubular elements between the first structure and the second structure;

with the second structure, breaking out a connection of a tubular element or assembly of tubular elements from a drillstring of the second wellbore;

lifting the tubular element or assembly of tubular elements; and with the motion controlled trolley, moving the tubular element or assembly of tubular elements from a first position from the second structure to a second position at the first structure.

25. The method according to claim 24, further comprising:

attaching the tubular element or assembly of tubular elements to a drillstring in the first wellbore;

releasing the tubular element or assembly of tubular elements from a hoist; and moving the motion controlled trolley from the first structure back to the second structure.

26. The method according to claim 24, wherein the method is automated and performed by a computer system executing computer software instructions stored on the computer system.

27. The method according to claim 24, wherein the first structure and the second structure are less than or equal to 200 feet apart.

28. The method according to claim 24, wherein the method is performed in less than or equal to 60 seconds, less than or equal to 75 seconds, less than or equal to 90 seconds, or less than or equal to 120 seconds.

29. The method according to claim 24, wherein performing the method takes from 40 seconds to 90 seconds to complete.

* * * * *